US007277670B2

(12) United States Patent
Yuasa

(10) Patent No.: US 7,277,670 B2
(45) Date of Patent: Oct. 2, 2007

(54) DOUBLE-SIDED IMAGE FORMING APPARATUS

(75) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/827,419

(22) Filed: Apr. 20, 2004

(65) Prior Publication Data

US 2004/0213610 A1 Oct. 28, 2004

(30) Foreign Application Priority Data

Apr. 24, 2003 (JP) ..... 2003-119545

(51) Int. Cl.
*G03G 15/00* (2006.01)

(52) U.S. Cl. ..... 399/401; 399/45

(58) Field of Classification Search ..... 399/45, 399/401, 400, 405, 397, 402, 364; 271/902, 271/186; 355/24

See application file for complete search history.

(56) References Cited

U.S. PATENT DOCUMENTS

| | | | | |
|---|---|---|---|---|
| 4,956,678 | A | 9/1990 | Kiya et al. | 399/401 |
| 5,037,083 | A * | 8/1991 | Johdai et al. | 271/288 |
| 5,473,419 | A * | 12/1995 | Russel et al. | 399/130 |
| 5,599,117 | A * | 2/1997 | Faes et al. | 400/605 |
| 6,002,906 | A * | 12/1999 | Hino et al. | 399/303 |
| 6,070,023 | A * | 5/2000 | Kataoka | 399/45 |
| 6,161,930 | A * | 12/2000 | Asano | 347/102 |
| 6,286,831 | B1 * | 9/2001 | Marasco et al. | 271/303 |
| 6,298,778 | B1 * | 10/2001 | Onodera et al. | 101/232 |
| 6,327,444 | B1 * | 12/2001 | Hachisuga | 399/45 |
| 6,804,477 | B2 * | 10/2004 | Maruyama | 399/45 |
| 2001/0009615 | A1 * | 7/2001 | Yokobori et al. | 399/45 |
| 2002/0001476 | A1 * | 1/2002 | Nagamine et al. | 399/45 |
| 2002/0018679 | A1 | 2/2002 | Miyajima | 399/389 |
| 2003/0044189 | A1 * | 3/2003 | Okitsu et al. | 399/45 |

FOREIGN PATENT DOCUMENTS

| | | |
|---|---|---|
| JP | 10-310286 | 11/1998 |
| JP | 11-208962 | 8/1999 |

* cited by examiner

*Primary Examiner*—Anthony H. Nguyen
(74) *Attorney, Agent, or Firm*—Rabin & Berdo, PC

(57) ABSTRACT

An image forming apparatus has an image forming unit that forms an image on one side of a recording medium, and a return unit that returns the recording medium to the image forming unit so that an image can be formed on the other side. A control unit selects different transport speeds for different types of recording media on at least part of the return path, preferably selecting a comparatively high speed for normal recording media and a slower speed for recording media that are thicker or stiffer than normal, as sensed by a thickness or stiffness sensor or inferred indirectly from another setting such as a fusing temperature setting. Thick or stiff recording media can then negotiate tight turns on the return path without transport failure, while normal media can be transported at high speed on the entire return path.

17 Claims, 17 Drawing Sheets

DOUBLE-SIDED IMAGE FORMING APPARATUS

BACKGROUND OF THE INVENTION

1. Field of the Invention

The present invention relates to image forming apparatus having a double-sided image forming function, more particularly to the control of media transport speed in such apparatus.

2. Description of the Related Art

The media transport path in a conventional image forming apparatus having a double-sided image forming function is illustrated in FIG. 18. The media transport path in this apparatus, which is described in Japanese Unexamined Patent Application Publication No. 11-208962, begins in a feeding unit 1. Driven by a driving system not shown in the drawing, the feeding unit 1 feeds paper or other recording media from a cassette 2 toward a feed sensor 3 and a timing adjustment unit 4. As the recording medium leaves the timing adjustment unit 4, its thickness is sensed by a media thickness sensor 5 using, for example, a sensing method disclosed in Japanese Unexamined Patent Application Publication No. 10-31028, and a media thickness assessment module 6 is informed of the result. The recording medium then enters an image forming unit 7 in which an image is formed on one side of the recording medium by an electrophotographic process.

Next, the recording medium travels to a fuser 8 that applies heat and pressure to fuse the image onto the recording medium. The media thickness assessment module 6 indicates the thickness of the recording media to a fusing temperature control module, not shown in the drawing, that selects a fusing temperature suitable for the indicated thickness and controls the fuser 8 so as to bring the fusing temperature to the selected temperature.

The recording medium, carrying the fused image, now enters a delivery path 9 that carries it to a pair of delivery and reversing rollers 10 in a delivery unit 11. For one-sided image formation, also referred to as one-sided printing, the delivery and reversing rollers 10 deliver the recording medium from the delivery unit 11 to the exterior of the apparatus, completing the image forming process. For double-sided printing, a media reversing unit 13 including the delivery and reversing rollers 10 and a position sensor 12 sends the recording medium back into the image forming apparatus. Specifically, at a timing triggered by the position sensor 12, the direction of rotation of the delivery and reversing rollers 10 is reversed, reversing the transport direction of the recording medium. The recording medium is then carried into a return path 14 that branches away from the delivery path 9 so that the recording medium is in effect turned over.

While moving through the image forming unit 7 and on toward the delivery unit 11, and while being delivered, the recording medium travels at a predetermined speed V1. While moving in reverse, from the delivery and reversing rollers 10 back to the return path 14, the recording medium travels at a speed V2 faster than speed V1.

The return path 14 includes a transport sensor 15 and three pairs of refeeding rollers 16, 17, 18, which are driven and controlled so as to feed the recording medium to the timing adjustment unit 4 again. During this refeeding process, the recording medium continues to travel at the faster speed V2.

From the return path 14, the recording medium is fed through the timing adjustment unit 4 into the image forming unit 7 again, and another image is formed on the reverse side of the recording medium. This image is also fused by the fuser 8; then the recording medium is carried on the delivery path 9 to the delivery unit 11 and delivered to the exterior of the apparatus by the delivery and reversing rollers 10, completing the double-sided image forming process.

With increasing awareness of environmental issues and energy conservation, the double-sided printing function has come into wide use, and there is a growing need for image forming apparatus capable of double-sided printing on various different types of media. There is furthermore a rising expectation of faster printing speeds, and media transport speeds in image forming apparatus have accordingly increased significantly. In order to enable high-speed double-sided printing, the return transport speed (V2) must be considerably faster than the transport speed (V1) in the image forming unit. In the conventional apparatus, the return transport speed V2 has a fixed value independent of the type of recording media.

The demand for faster printing speed is matched by a rising demand for more compact apparatus, so the space available for accommodating additional functions such as double-sided printing has become extremely small. Therefore, when a double-sided printing function is present, the return path tends to include tight curves. The recording medium must negotiate these tight curves at high speed, so if the printing medium is thick and the driving motor does not have sufficiently high torque, there is a risk of transport failure due to the increased medium transport load. This type of transport failure can be prevented by using a large motor with high torque, but then the size and manufacturing cost of the apparatus are increased.

SUMMARY OF THE INVENTION

An object of the present invention is to provide, at low cost, a compact image forming apparatus capable of forming images on both sides of normal recording media quickly, and on both sides of thick recording media without transport failures.

The invented image forming apparatus has an image forming unit that forms an image on one side of a recording medium, a transport unit that transports the recording medium through the image forming unit, and a return unit that receives the recording medium from the image forming unit, transports the recording medium on a return path, and feeds the recording medium into the image forming unit again so that the image forming unit can form an image on the reverse side of the recording medium.

The image forming apparatus also has a control unit that selects different transport speeds for different types of recording media, and controls the return unit so that the different types of recording media are transported at the selected speeds on at least part of the return path. The control unit preferably selects a comparatively high speed for normal recording media, and a slower speed for recording media that are thicker or stiffer than normal. The image forming apparatus may accordingly include a sensor for sensing the thickness of stiffness of the recording medium. Alternatively, the thickness of the recording medium may be inferred indirectly from a fusing temperature, or from the speed with which the recording medium is transported through the image forming unit.

DETAILED DESCRIPTION OF THE INVENTION

Figure 1A:
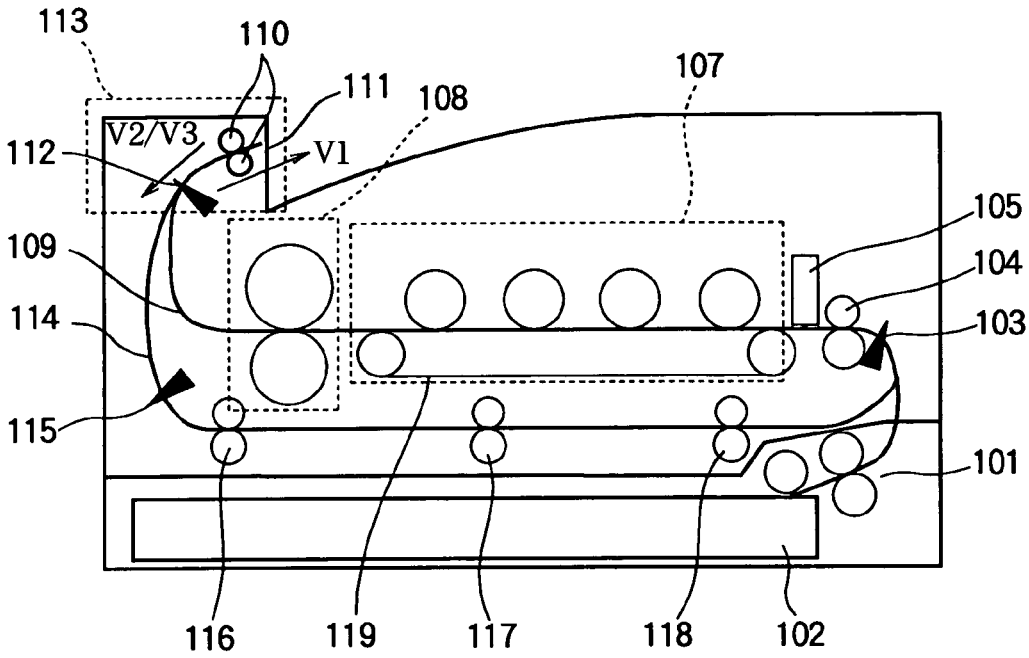
FIG. 1A illustrates the structure of the media transport path in an image forming apparatus exemplifying a first embodiment of the invention.

Embodiments of the invention will now be described with reference to the attached drawings, in which like elements are indicated by like reference characters.

First Embodiment

Referring to FIG. 1A, the first embodiment is an image forming apparatus having a recording medium transport path with substantially the same structure as in the conventional apparatus described above. A feeding unit 101 driven by a driving system (not shown) feeds a recording medium such as a sheet of paper from a cassette 102 toward a feed sensor 103, a timing adjustment unit 104, and a media thickness sensor 105. The feed sensor 103 detects the leading and trailing edges of the recording medium. The timing adjustment unit 104 synchronizes the further transport of the recording medium with the operation of an image forming unit 107, which the recording medium enters next, and corrects skew, so that the image formed by the image forming unit is correctly aligned with the leading edge of the recording medium. The image is formed by a color electrophotographic process on one side of the recording medium, which is then transported through a fuser 108 to a delivery path 109. For one-sided printing, a pair of delivery and reversing rollers 110 in a delivery unit 111 deliver the recording medium to the exterior of the apparatus, completing the image forming process.

For double-sided printing, when the trailing edge of the recording medium passes a position sensor 112, a media reversing unit 113 reverses the direction of rotation of the delivery and reversing rollers 110, sending the recording medium back toward a return path 114. The return path 114 comprises a transport sensor 115 and pairs of refeeding rollers 116, 117, 118 that transport the recording medium back to the feed sensor 103 and timing adjustment unit 104 with its orientation reversed. The refeeding rollers 116, 117, 118 may be driven separately from the delivery and reversing rollers 110, or all four pairs of rollers 110, 116, 117, 118 may be driven by the same motor (not shown).

The recording medium is now fed through the image forming unit 107 again to form an image on the reverse side. Finally, the recording medium is transported through the fuser 108 onto the delivery path 109 and delivered from the delivery unit 111 to the exterior of the apparatus by the delivery and reversing rollers 110, completing the double-sided image forming process.

The media reversing unit 113 and return path 114, including their rollers 110, 116, 117, 118 and sensors 112, 115, constitute the return unit of the image forming apparatus.

Within the image forming unit 107, the recording medium is transported on a media transport belt in a media transport unit 119.

Figure 1B:
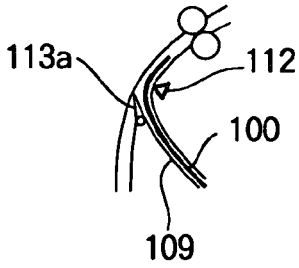
FIGS. 1B and 1C illustrate switching of the media transport path in FIG. 1A.
Figure 1C:
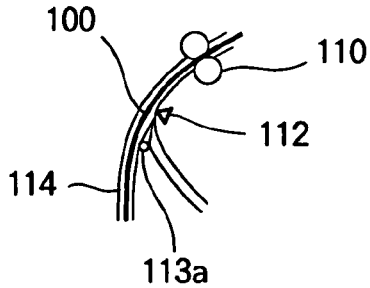

Referring to FIGS. 1B and 1C, the media reversing unit 113 includes a switch 113*a* that is set to the position shown in FIG. 1B while the recording medium 100 is traveling in the forward direction on the delivery path 109, and to the position shown in FIG. 1C while the recording medium 100 is traveling in the reverse direction from the delivery and reversing rollers 110 to the return path 114.

Figure 1D:
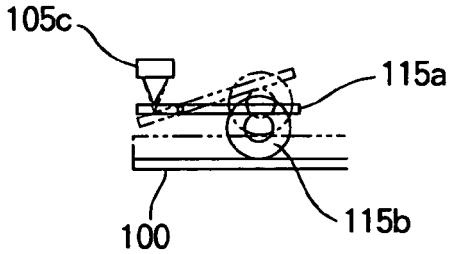
FIG. 1D shows an exemplary structure of the media thickness sensor in FIG. 1A.

Referring to FIG. 1D, the media thickness sensor 105 comprises, for example, a lever 105*a* that rotates about a fixed pivot. One end of the lever 105*a* rests on the shaft of a roller 105*b* that makes contact with the recording medium 100; the other end of the lever 105*a* has a reflector that faces a reflective sensor 105*c*. The reflective sensor 105*c* emits light toward the reflector and detects the light reflected back. The distance between the lever 105*a* and the reflective sensor 105*c* varies according to the thickness of the recording medium 100 so that as the thickness of the recording medium increases, the intensity of the reflected light decreases, and with it the strength of the signal (not shown) output from the reflective sensor 105*c*. The strength of this signal is measured in advance for recording media of various thicknesses, and the measurement results are stored in a table from which the thickness of the recording medium can be read according to the sensor output.

Figure 2:
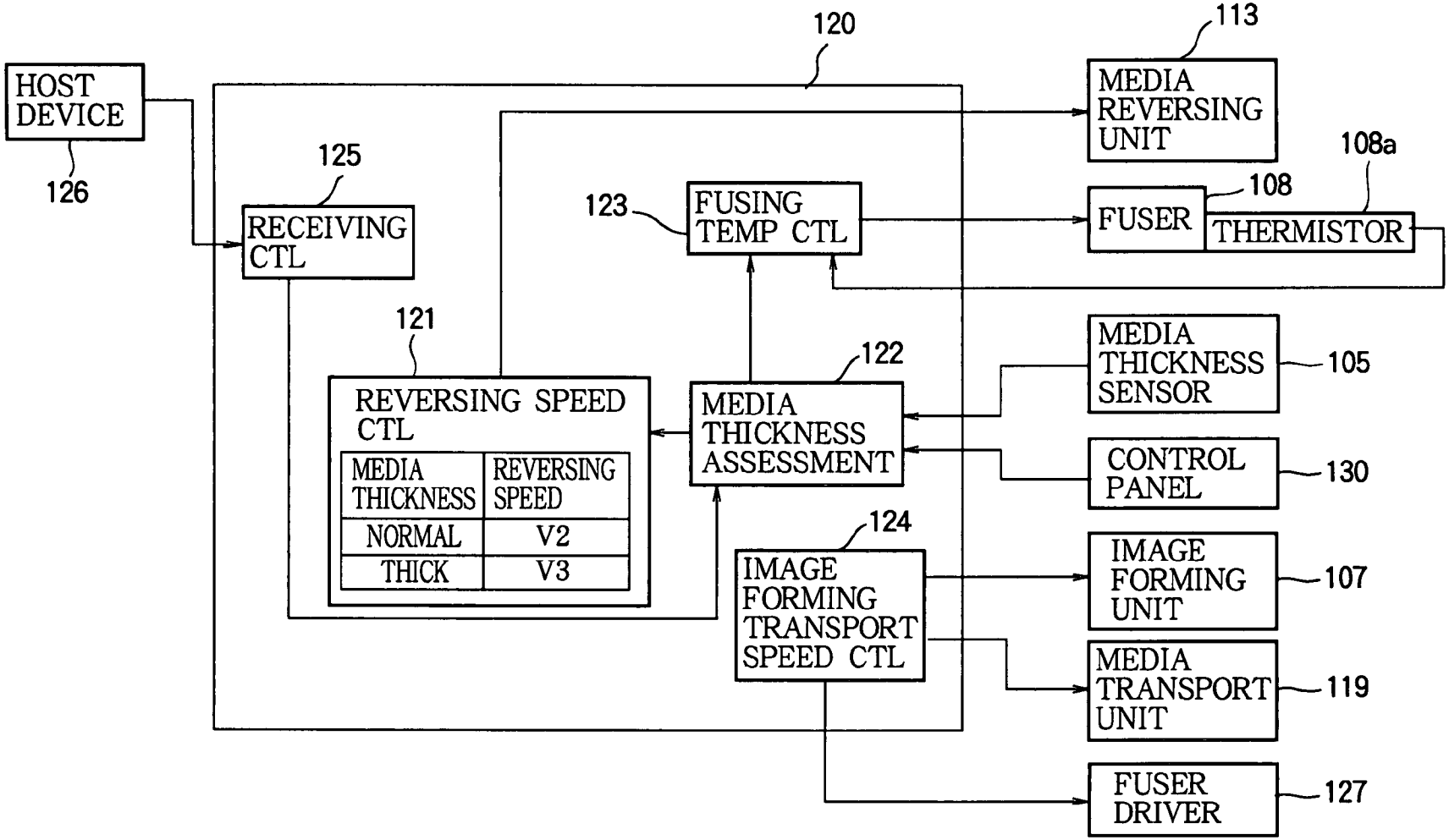
FIG. 2 is a block diagram showing the structure of the control system of the image forming apparatus in the first embodiment.

Referring to FIG. 2, the image forming apparatus has a control unit 120 including modules for reversing speed control (CTL) 121, media thickness assessment 122, fusing temperature (TEMP) control 123, image forming transport speed control 124, and receiving control 125. These modules may be hardware modules, or software modules executed by a computing device (not shown) in the control unit 120.

The receiving control module 125 receives information from a host device 126 by which the image forming apparatus is controlled. The image forming apparatus can also be controlled from a control panel 130. The media thickness assessment module 122 receives information from the media thickness sensor 105, the receiving control module 125, and the control panel 130, and assesses the thickness of the recording medium according to the received information. In the present embodiment, the media thickness assessment module 122 designates the recording medium as either normal or thick, and sends the normal or thick designation to the reversing speed control module 121 and the fusing temperature control module 123.

The image forming transport speed control module 124 controls the media transport unit 119 so that the recording medium is transported through the image forming unit 107 at a constant speed V1. The image forming transport speed control module 124 also controls a fuser driver 127 that drives the fuser 108, so as to maintain the same constant speed V1 on the delivery path 109.

The fusing temperature control module 123 determines and controls the fusing temperature setting of the fuser 108, setting a comparatively low fusing temperature for normal recording media and a higher fusing temperature for recording media designated as thick by the media thickness assessment module 122. The fusing temperature is sensed by a thermistor 108*a* in the fuser 108. The fusing temperature control module 123 receives the temperature sensing result and adjusts the fusing temperature accordingly.

The reversing speed control module 121 controls the speed of the recording medium while the transport direction is being reversed by the delivery and reversing rollers 110 in the media reversing unit 113. This speed is controlled according to the thickness of the recording media as indicated by the media thickness assessment module 122. Normal recording media are transported at a speed V2 greater than the speed V1 in the image forming unit 107 and on the delivery path 109. Thick recording media are transported at a speed V3 slower than speed V2, but equal to or greater than speed V1. Reducing the reverse transport speed from V2 to V3 increases the torque of the motor or motors that drive the rollers 110, 116, 117, 118. This scheme enables normal recording media (55-kilogram paper, for example) to be transported at the comparatively high speed V2 while thick recording media such as postcards are transported at a speed V3 slow enough for the media to negotiate the turns in the reversing part of the return path 114.

Depending on the geometry of the of the return path 114, the reversing speed control module 121 may control the reverse transport speed until the trailing edge of the recording medium has left the delivery and reversing rollers 110, until the leading edge of the recording medium arrives at the first refeeding roller pair 116, or until the leading edge of the recording medium arrives at the timing adjustment unit 104. In the subsequent description it will be assumed that reversing speed control lasts until the trailing edge of the recording medium has left the delivery and reversing rollers 110.

After the recording medium has been returned to the timing adjustment unit 104, the transport speed is reset to V1 for transport through the image forming unit 107, as in one-sided printing.

Figure 3:
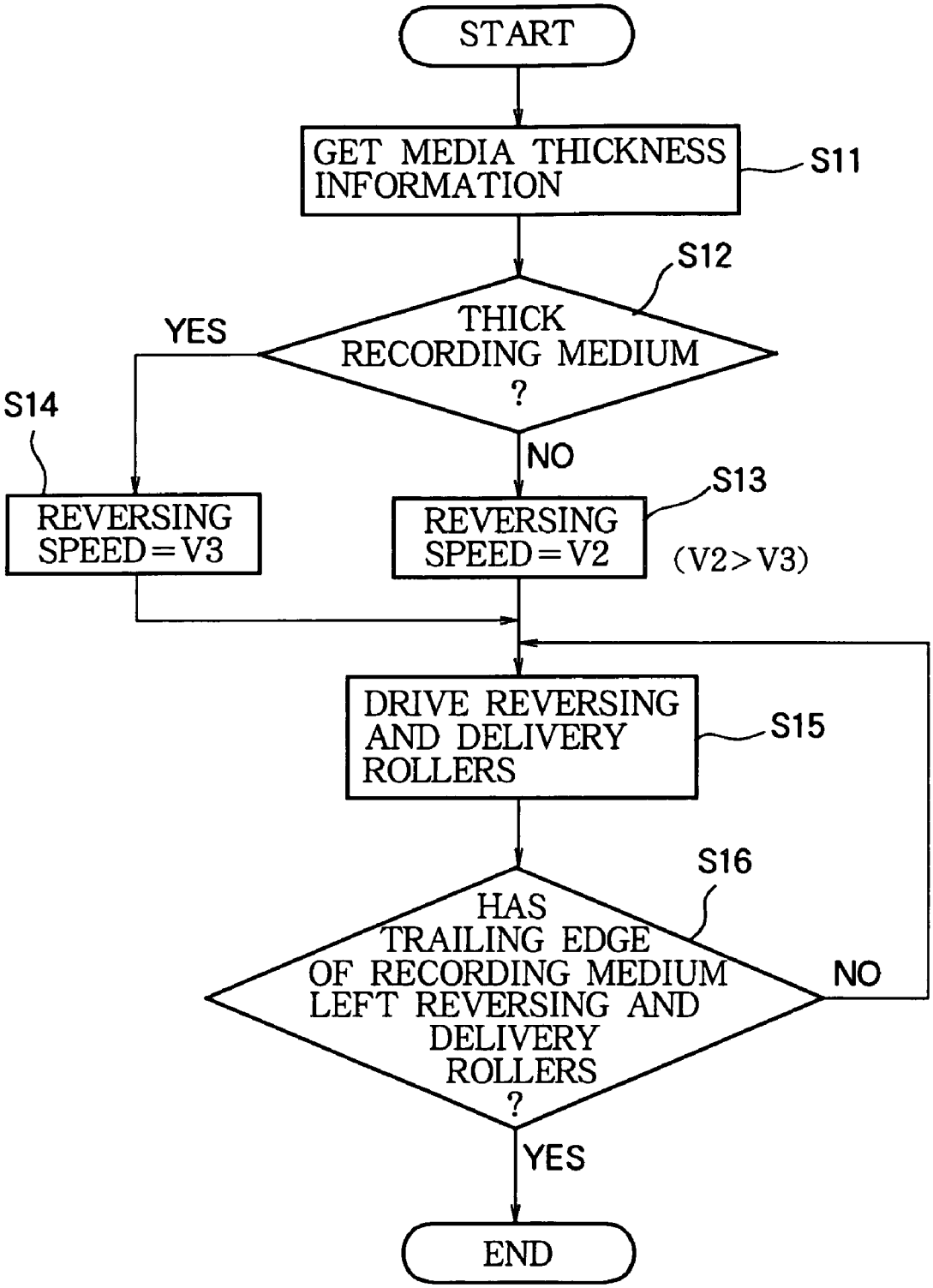
FIG. 3 is a flowchart illustrating the media reversing operation in the first embodiment.

Next, the media reversing operation in the first embodiment will be described with reference to the flowchart in FIG. 3. In double-sided printing, information on the thickness of the recording medium is obtained (step S11), and whether the recording medium is normal or thick is determined (step S12). If the recording medium has normal thickness, the reversing speed is set to speed V2 (step S13); if the recording medium is thicker than normal, the reversing speed is set to speed V3 (step S14). The delivery and reversing rollers 110 are then driven in reverse to transport the recording medium at the set speed (step S15) until the trailing end of the recording medium is determined to have left the delivery and reversing rollers 110 (step S16), e.g., until the trailing edge of the recording medium passes the position sensor 112.

Although the media thickness assessment module 122 in the first embodiment was described as receiving information from the media thickness sensor 105, the receiving control module 125, and the control panel 130, information from only one of these sources is sufficient. For example, the control panel 130 need not have a control feature related to media thickness, in which case the media thickness assessment module 122 need not receive information from the control panel 130. Similarly, if the host device 126 does not supply information related to media thickness, the media thickness assessment module 122 need not receive information from the receiving control module 125. Conversely, the media thickness sensor 105 may be eliminated and the media thickness assessment module may rely solely on information from the control panel 130 or receiving control module 125, or both. Information related to media thickness may be, for example, information designating a specific type of recording media, such as 'postcard', since postcards are thicker than normal recording media. Information related to the weight of the recording media may also be used. If the media thickness assessment module 122 receives information from more than one source, the normal or thick designation may be made according to a priority order among the information sources.

Although the slower reversing speed V3 was described above as being equal to or greater than the image forming transport speed V1, if necessary, the slower reversing speed V3 may be slower than the image forming transport speed V1.

Although only two reversing speeds V2 and V3 were described above, if necessary, the first embodiment may use three or more reversing speeds according to the thickness of the recording medium and its position on the return transport path.

Figure 4:
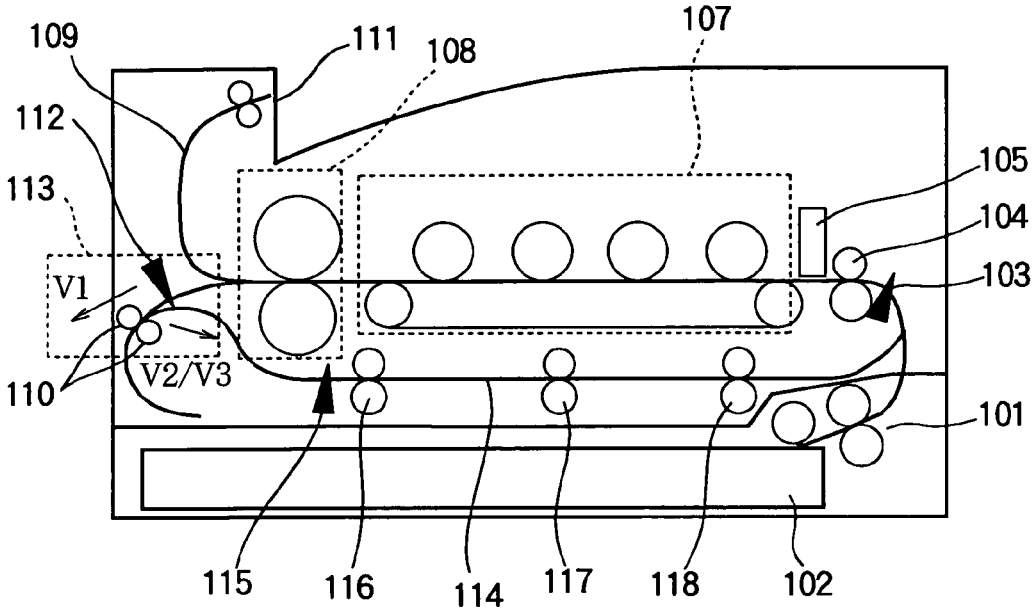
FIG. 4 illustrates another possible structure of the media transport path in the first embodiment.

The first embodiment may also be modified so that in double-sided printing, the recording medium is reversed by being drawn downward from the fuser 108, as shown in FIG. 4. In this case the media reversing unit 113 is separate from the delivery unit 111, and the recording medium does not appear outside the image forming apparatus while its transport direction is being reversed.

As described above, by slowing the reversing speed for thick recording media during the reversing process, the first embodiment increases the torque margin in this process. The image forming apparatus can therefore form images on both sides of thick recording media reliably even if the reversing part of the return path includes tight curves, without requiring a motor of increased size, and without slowing the double-sided image forming process for normal recording media.

Second Embodiment

Figure 5:
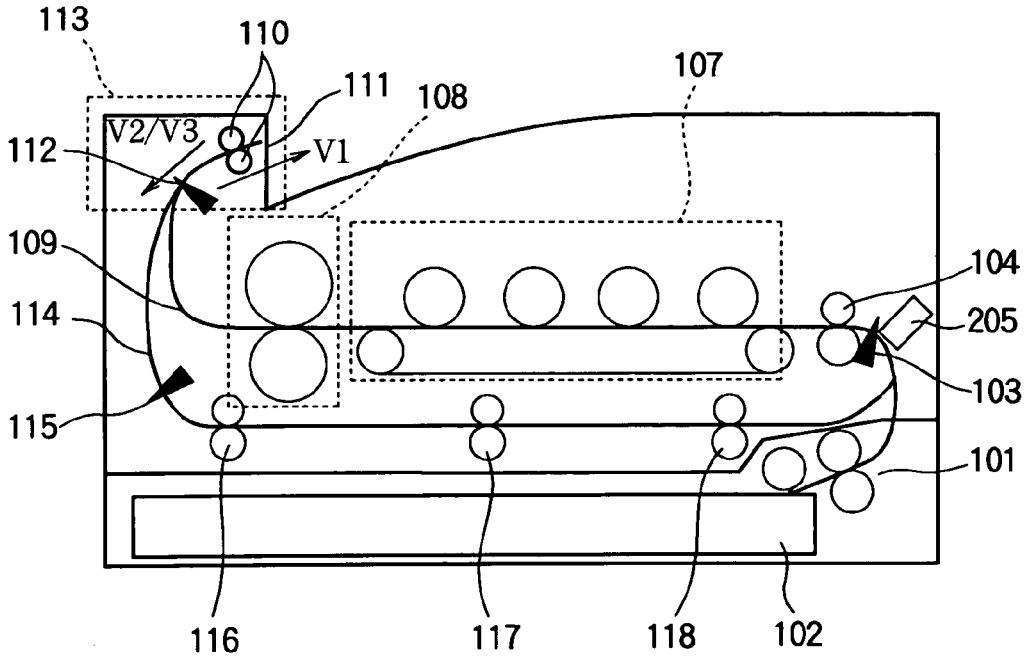
FIG. 5 illustrates the structure of the media transport path in an image forming apparatus exemplifying a second embodiment of the invention.
Figure 6:
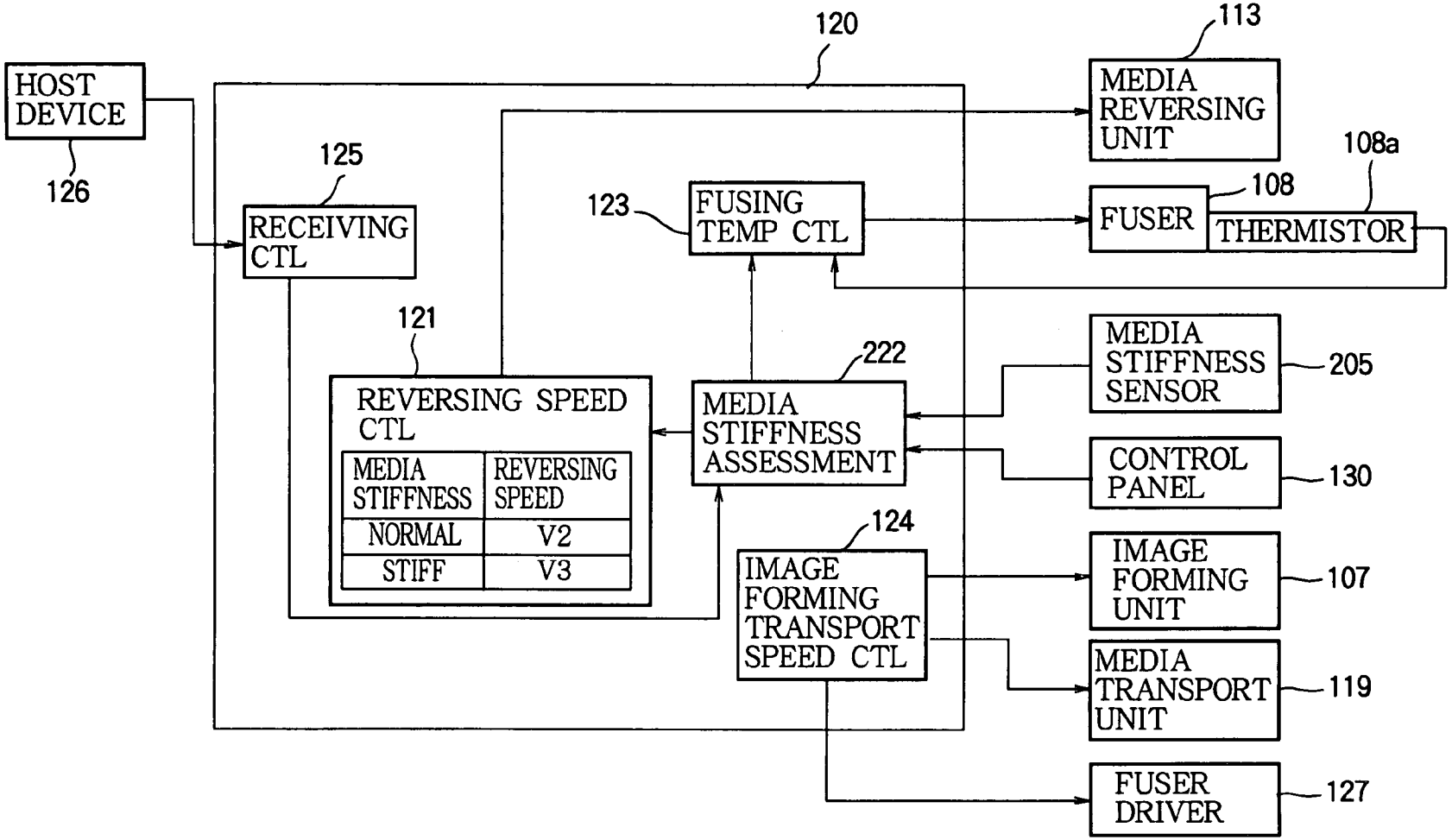
FIG. 6 is a block diagram showing the structure of the control system of the image forming apparatus in the second embodiment.

An image forming apparatus according to a second embodiment of the invention has a recording medium transport path with the structure shown in FIG. 5 and a control system with the structure shown in FIG. 6. Elements identical or equivalent to elements in FIGS. 1 and 2 are indicated by the same reference characters; repeated descriptions will be omitted. The second embodiment differs from the first embodiment by replacing the media thickness sensor and media thickness assessment module of the first embodiment with a media stiffness sensor 205 and a media stiffness assessment module 222.

Figure 7A:
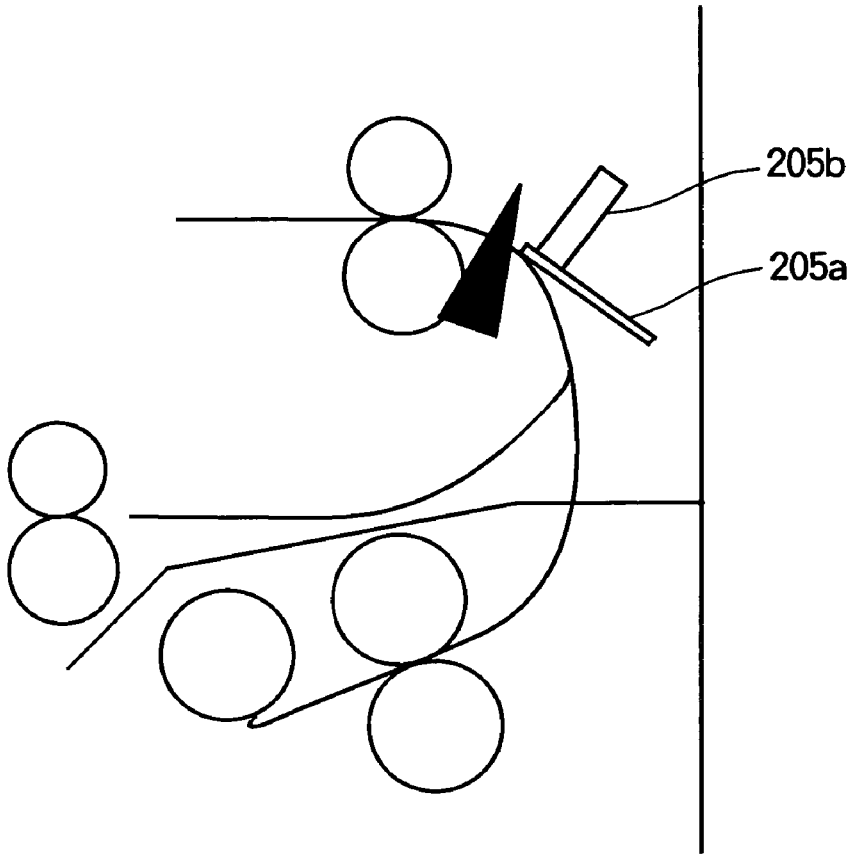
FIG. 7A schematically illustrates the structure of the medium stiffness detection unit in FIG. 5.
Figure 7B:
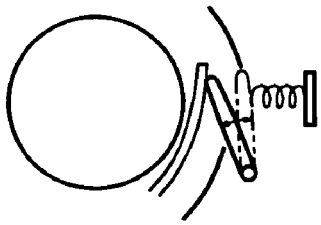
FIG. 7B shows an exemplary structure of the media stiffness sensor in FIG. 7A.

The media stiffness sensor 205 is installed on a side wall of the housing of the image forming apparatus at a point at which the media transport path has a small radius of curvature. Referring to FIG. 7A, the media stiffness sensor 205 has a media stiffness sensing member 205*a* that makes contact with the recording medium. During the feeding of the recording medium, the force with which the leading edge of the recording medium presses against the media stiffness sensing member 205*a* is detected by means of a media stiffness sensing spring 205*b*. The media stiffness sensing member 205*a* and spring 205*b* are preferably disposed near a roller as shown in FIG. 7B. The amount of compression of the spring 205*b* is converted to a signal that is sent to the media stiffness assessment module 222 in FIG. 6.

The media stiffness sensor 205 is not limited to the structure shown in FIGS. 7A and 7B. For example, media stiffness can also be sensed by measuring the movement of a lever with a reflective sensor as in the media thickness sensor 105 in the first embodiment.

The media stiffness assessment module 222 in FIG. 6 determines the stiffness of the recording medium according to the signal received from the media stiffness sensor 205, as well as from information (if available) from the control panel 130 and receiving control module 125, designates the recording medium as normal or stiff (stiff meaning stiffer than normal), and notifies the reversing speed control module 121 of the stiffness designation. The reversing speed control module 121 sets the reversing speed of the recording medium accordingly, and controls the media reversing unit 113 during the reversing interval in double-sided printing. Recording media designated as normal are transported during this interval at the speed V2 described in the first embodiment. Recording media designated as stiff are transported at the slower speed V3.

Figure 8:
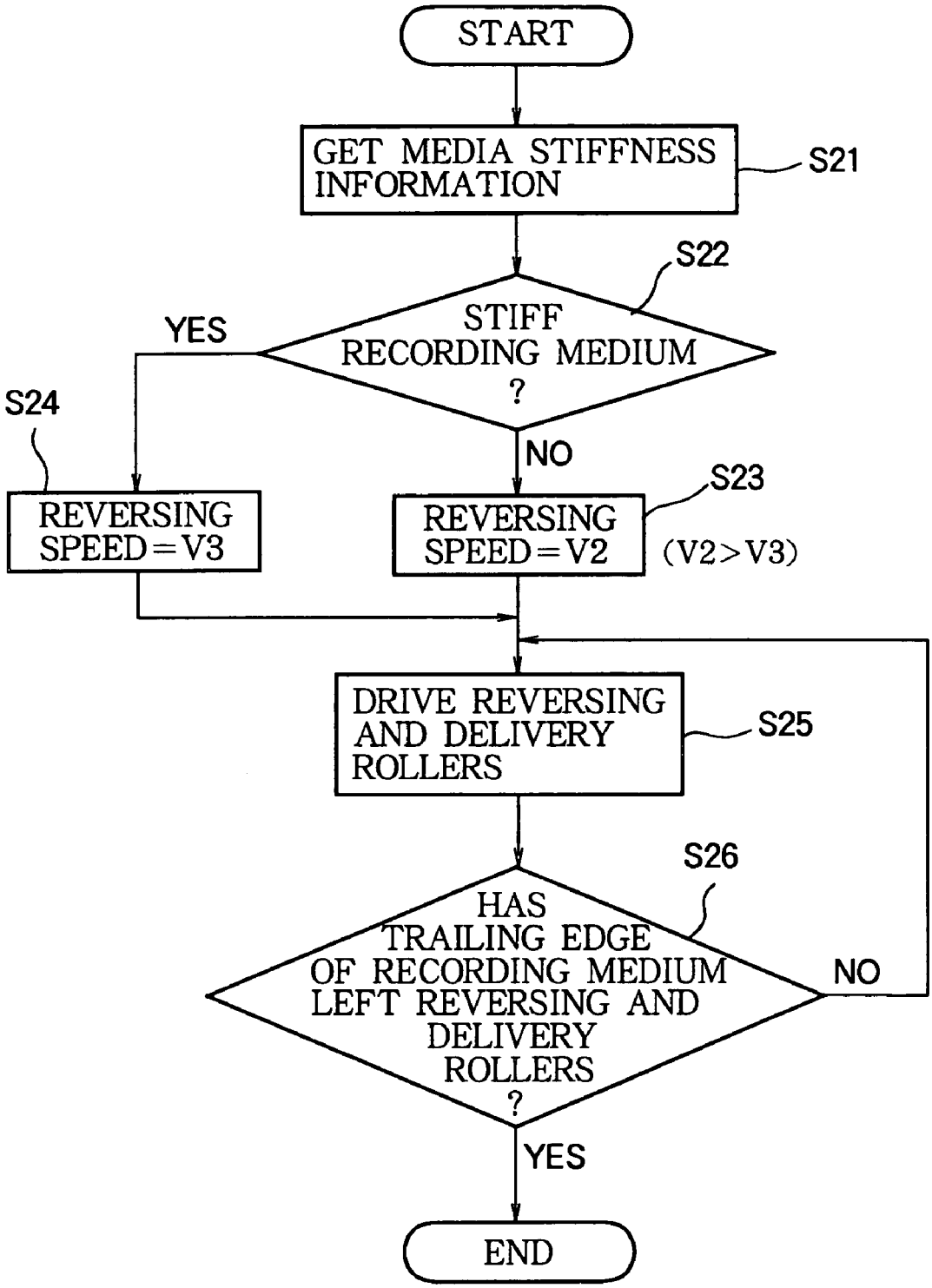
FIG. 8 is a flowchart illustrating the media reversing operation in the second embodiment.

The media reversing operation is illustrated in the flowchart in FIG. 8. In double-sided printing, information on the stiffness of the recording medium is obtained (step S21), and whether the recording medium has normal stiffness or is stiffer than normal is determined (step S22). If the recording medium has normal stiffness, the reversing speed is set to speed V2 (step S23); if the recording medium is stiffer than normal, the reversing speed is set to speed V3 (step S24). The delivery and reversing rollers 110 are then driven in reverse to transport the recording medium at the set speed (step S25) until the trailing end of the recording medium is determined to have left the delivery and reversing rollers 110 (step S26).

The second embodiment has effects similar to those of the first embodiment, but since the bending stiffness of the recording medium, which is a direct factor in the load placed on the motors that transport the recording medium, is measured, the second embodiment can prevent transport failures more effectively.

Third Embodiment

Figure 9:
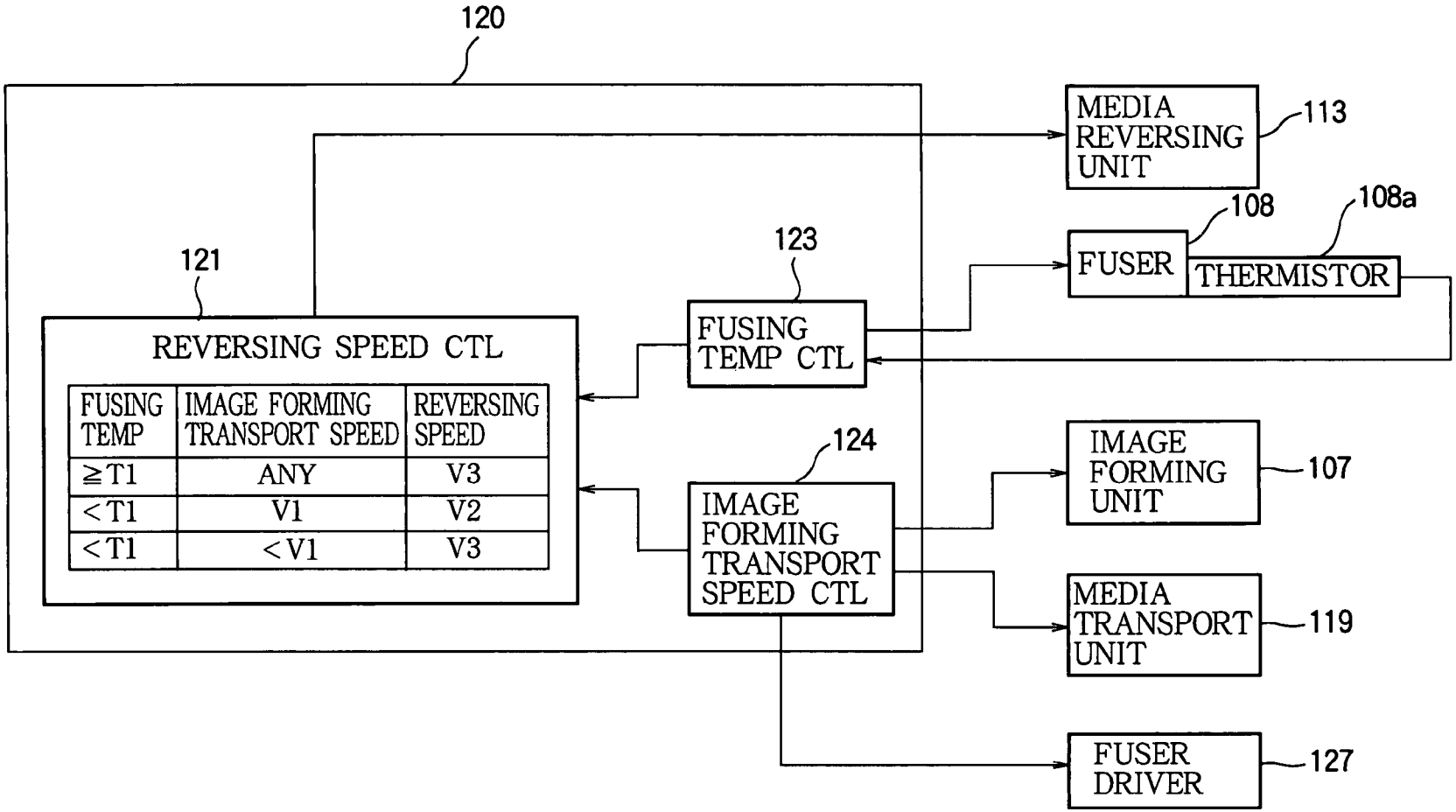
FIG. 9 is a block diagram showing the structure of the control system of an image forming apparatus according to a third embodiment of the invention.

In the third embodiment, reversing speed is controlled according to the fusing temperature or image forming transport speed, instead of the thickness or stiffness of the recording medium. An image forming apparatus according to a third embodiment has a control system with the structure shown in FIG. 9. The reversing speed control module 121 receives inputs from the fusing temperature control module 123 and the image forming transport speed control module 124. This control system can be used in a variety of image forming apparatuses.

Some image forming apparatuses have a control panel (not shown) on which the user can select the fusing temperature. For thick recording media, the user is advised to raise the fusing temperature to a higher temperature than normal. Alternatively, the fusing temperature may be set from the host device, and the host device may raise the fusing temperature for thick recording media.

Some other image forming apparatuses decrease the image forming transport speed instead of increasing the fusing temperature when forming images on thick recording media. The image forming transport speed is the transport speed of the recording medium in the image forming unit and fuser. Decreasing this speed enables the fusing characteristics of images formed on thick recording media to be improved without increasing the fusing temperature, because both heating temperature and heating time affect fusing performance.

The reversing speed control module 121 determines the reversing speed according to both the fusing temperature and the image forming transport speed. If the fusing temperature is equal to or greater than a predetermined threshold temperature T1, the reversing speed is set to a predetermined speed V3. If the fusing temperature is less than the threshold temperature T1 and the image transport speed in the image forming unit is the normal transport speed V1, the reversing speed is set to another predetermined speed V2. If the fusing temperature is less than the threshold temperature T1 and the image transport speed in the image forming unit is less than the normal transport speed V1, the reversing speed is set to the predetermined speed V3. As in the first and second embodiments, speed V2 is faster than speed V1, and speed V3 is slower than speed V2.

Figure 10:
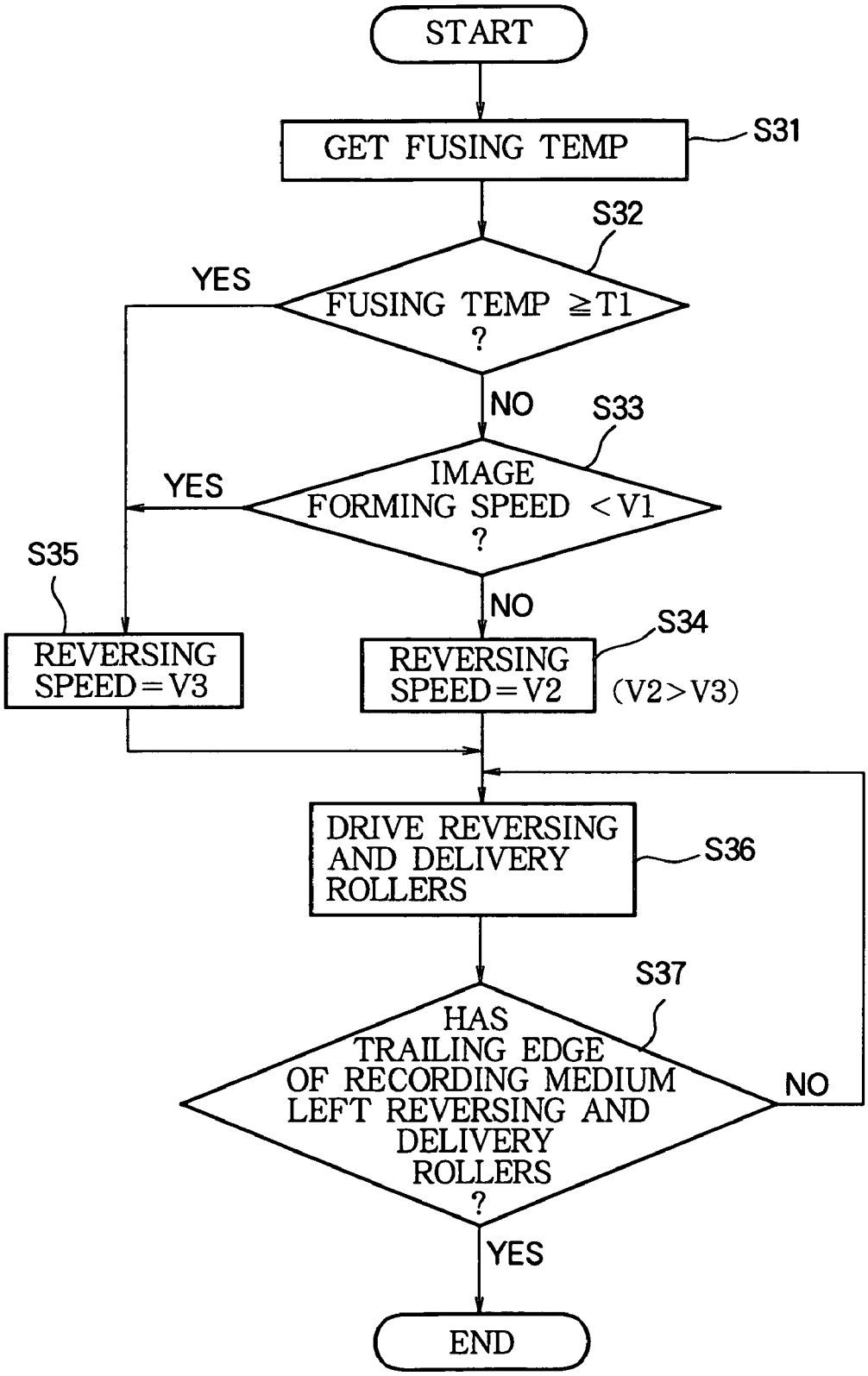
FIG. 10 is a flowchart illustrating the media reversing operation in the third embodiment.

The reversing operation in the third embodiment is illustrated in the flowchart in FIG. 10. In double-sided printing, the fusing temperature setting is read (step S31) and compared with the threshold temperature T1 (step S32). If the fusing temperature is lower than T1, the image forming transport speed is read and compared with the normal speed V1 (step S33). If the image forming transport speed is equal to (or greater than) V1, the reversing transport speed is set to the comparatively high speed V2 (step S34). If the image forming transport speed is found to be slower than the normal speed V1 in step S33, or if the fusing temperature is found to be equal to or greater than the threshold value T1 in step S32, the reversing transport speed is set to the comparatively slow speed V3 (step S35). When reverse transport begins, the delivery and reversing rollers are driven at the set reversing speed (step S36) until the trailing end of the recording medium is determined to have left the delivery and reversing rollers 110 (step S37).

The third embodiment can be used in an image forming apparatus that lacks sensors for sensing media thickness or stiffness, and does not receive thickness or stiffness information from a control panel or host device, or lacks means of storing such information. An advantage of the third embodiment is that it is not vulnerable to sensor failure.

The reverse transport control scheme of the third embodiment can be used as a back-up to the control scheme in the first or second embodiment, to be employed in the event of a sensor failure.

Fourth Embodiment

Figure 11:
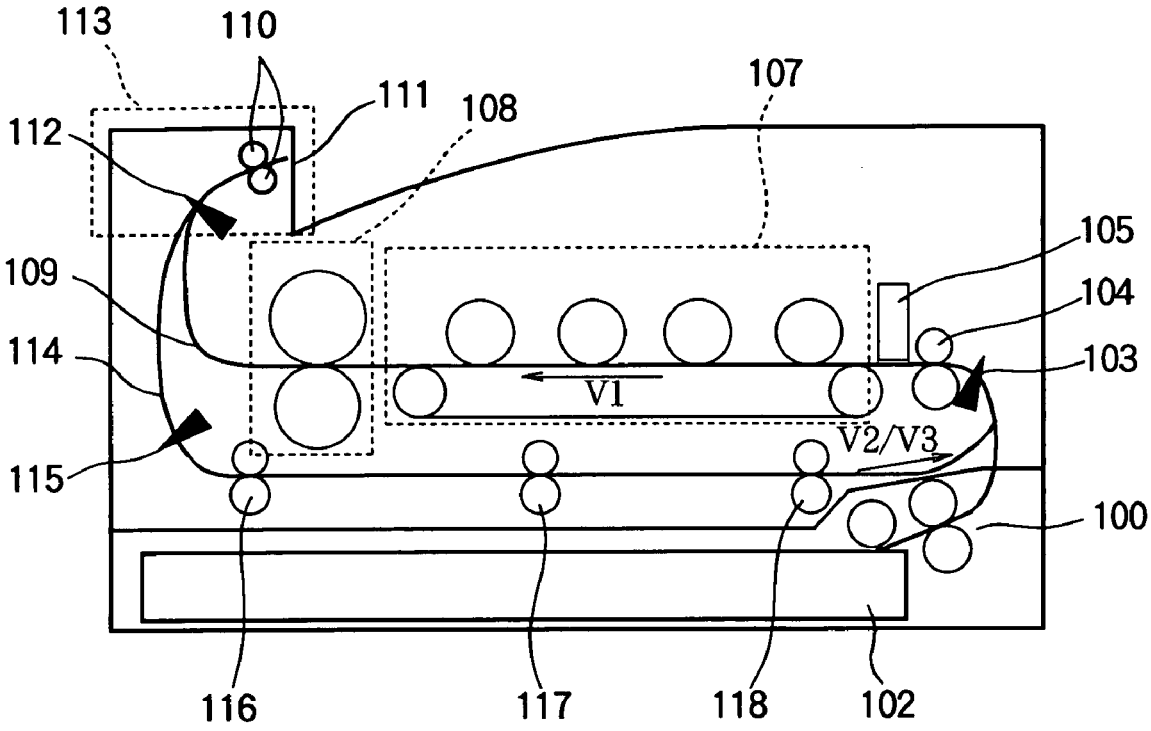
FIG. 11 illustrates the structure of the media transport path in an image forming apparatus in a fourth embodiment of the invention.
Figure 12:
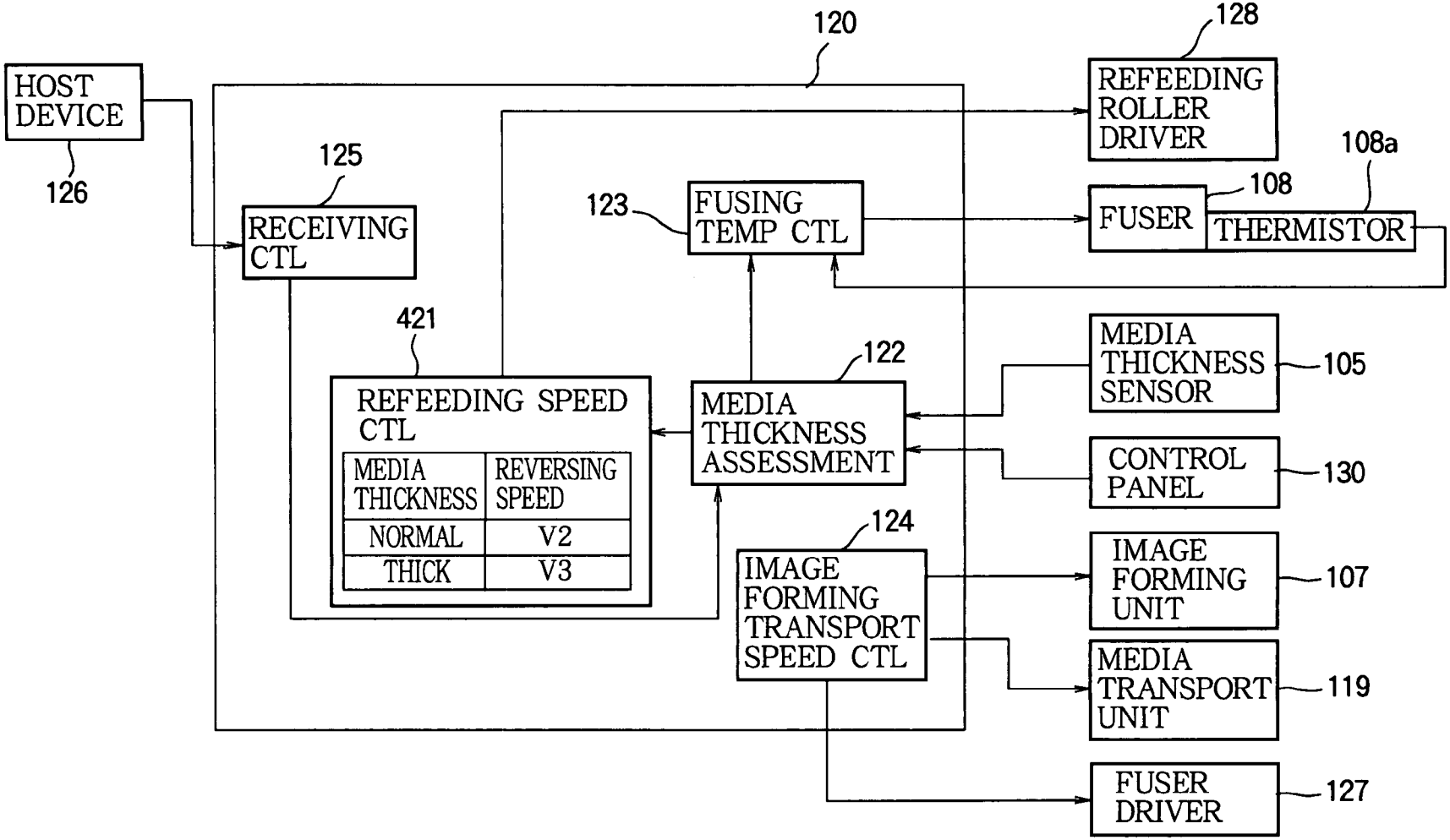
FIG. 12 is a block diagram showing the structure of the control system of the image forming apparatus according to the fourth embodiment.

Referring to FIG. 11, the image forming apparatus according to a fourth embodiment has the same media transport path as in the first embodiment. Referring to FIG. 12, the control system is also the same as in the first embodiment, except that the reversing speed control module of the first embodiment is replaced by a refeeding speed control module 421 controlling a refeeding roller driver 128 that drives the refeeding rollers 116, 117, 118.

On the basis of the thickness designation received from the media thickness assessment module 122, the refeeding speed control module 421 selects one of two speeds V2 and V3 at which the recording medium is to be refed from the refeeding rollers 116, 117, 118 to the timing adjustment unit 104. As in the first embodiment, speed V2 is faster than the image forming transport speed V1, and speed V3 is slower than speed V2. If the media thickness assessment module 122 designates the recording medium as having normal thickness, the refeeding speed control module 421 selects the faster refeeding speed V2. If the media thickness assessment module 122 designates the recording medium as thicker than normal, the refeeding speed control module 421 selects the slower refeeding speed V3, thereby increasing the torque output of the motor (not shown) in the refeeding roller driver 128.

The interval during which the refeeding speed is controlled by the refeeding speed control module 421 begins when the leading edge of the recording medium passes the last refeeding roller pair 118, or at a predetermined time thereafter, and lasts until the leading edge of the recording medium arrives at the timing adjustment unit 104. During the interval from when the leading edge of the recording medium passes the first refeeding roller pair 116 until the leading edge of the recording medium arrives at the last refeeding roller pair 118, the recording medium is preferably transported at the faster refeeding speed V2.

Figure 13:
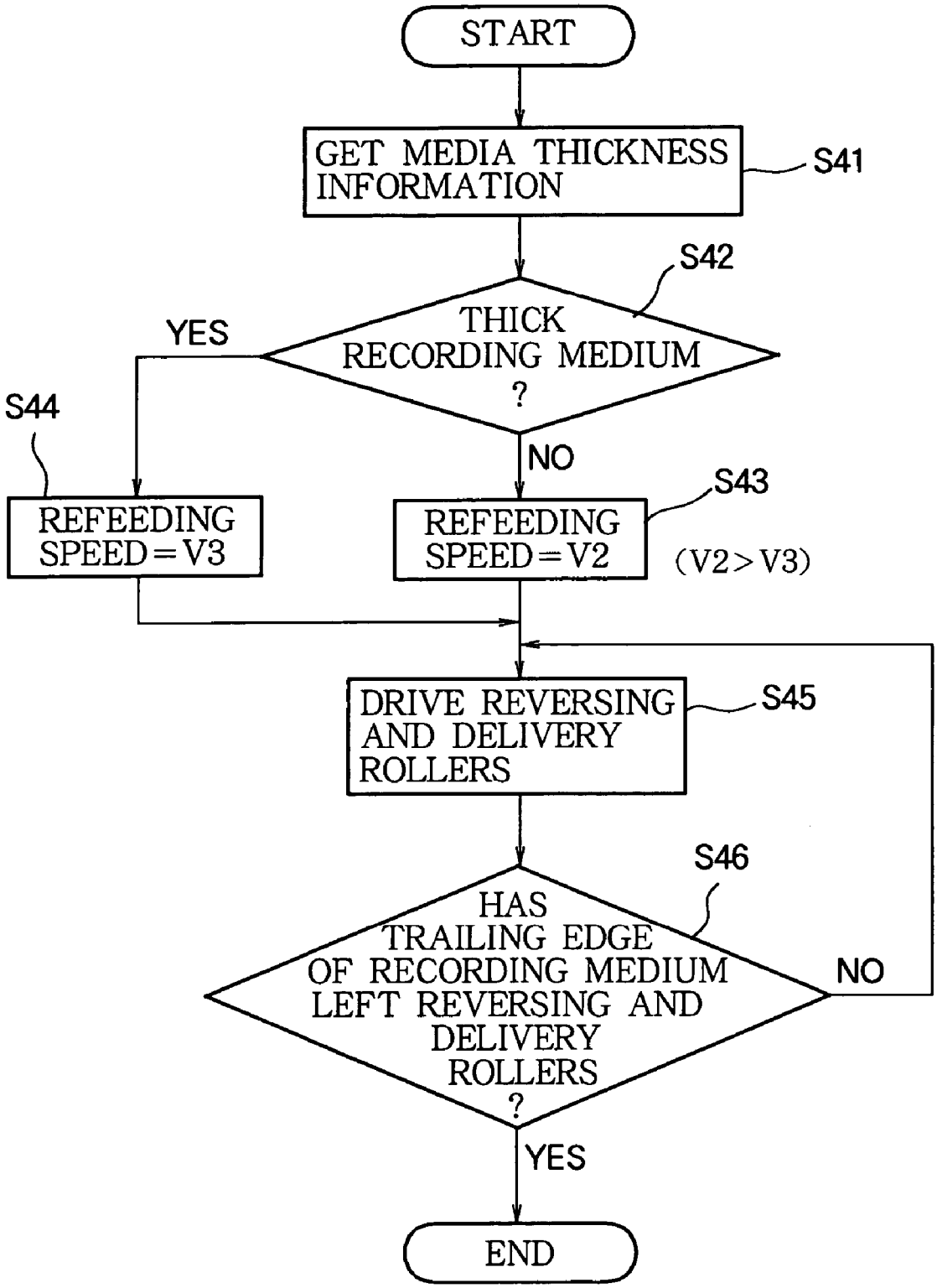
FIG. 13 is a flowchart illustrating the media refeeding operation in the fourth embodiment.

Next, the refeeding speed control operation carried out by the media thickness assessment module 122 and refeeding speed control module 421 will be described with reference to the flowchart in FIG. 13. In double-sided printing, information on the thickness of the recording medium is obtained (step S41), and whether the recording medium is thicker than normal or not is determined (step S42). If the recording medium has normal thickness, the refeeding speed is set to speed V2 (step S43); if the recording medium is thicker than normal, the refeeding speed is set to speed V3 (step S44). The rotational speed of the refeeding rollers 116, 117, 118 is then controlled so as to transport the recording medium at the set speed (step S45) until the leading edge of the recording medium is determined to have arrived at the timing adjustment unit 104 (step S46).

The fourth embodiment is not limited to the recording medium transport path shown in FIG. 11. The media reversing unit 113 may be separate from the delivery unit 111 as shown in FIG. 4. Control of the refeeding roller pairs 116, 117, 118 remains the same as in FIG. 12.

By slowing the transport speed of thick recording media in the last part of the return path 114, the fourth embodiment enables thick recording media to negotiate the tight curves between the last refeeding roller pair 118 and the timing adjustment unit 104 without slowing the transport speed on other parts of the return path 114, and without slowing the refeeding transport speed of normal recording media.

The fourth embodiment may be combined with the first embodiment to control the media transport speed on both the reversing and refeeding parts of the return path.

Fifth Embodiment

Figure 14:
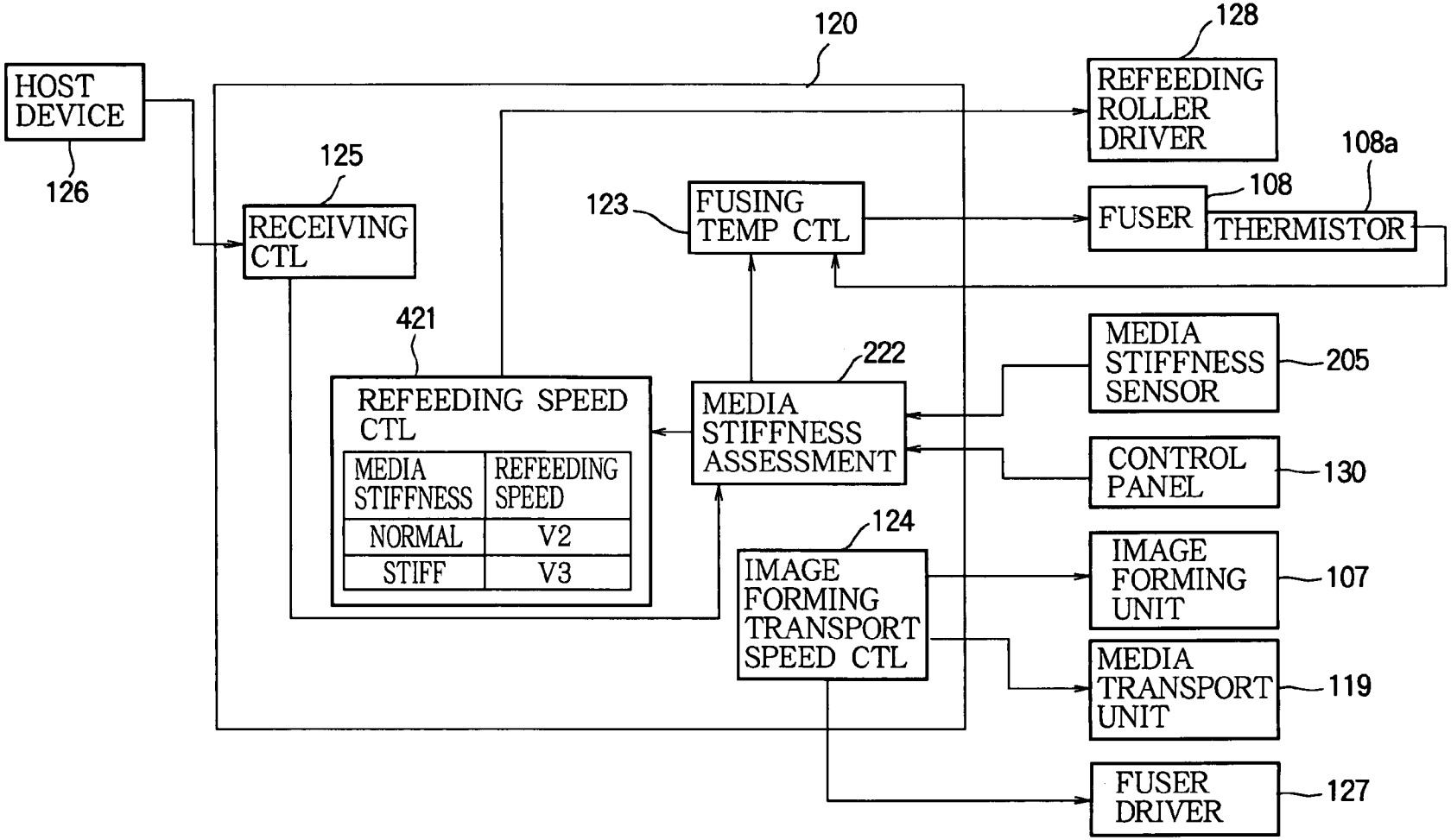
FIG. 14 is a block diagram showing the structure of the control system of an image forming apparatus in a fifth embodiment of the invention.

The image forming apparatus in the fifth embodiment has the same recording media transport path and control system as in the second embodiment, except that the reversing speed control module of the second embodiment is replaced by a refeeding speed control module 421 that controls a refeeding roller driver 128, as shown in FIG. 14. The refeeding speed control module 421 thereby controls the rotational speed of the refeeding rollers 116, 117, 118 so that the recording medium is transported at either one of the two speeds V2 and V3 described in the preceding embodiments, according to the stiffness designation received from the media stiffness assessment module 222.

If the media stiffness assessment module 222 identifies the recording medium as having normal stiffness, the refeeding speed control module 421 selects the faster refeeding speed V2. If the media stiffness assessment module 222 identifies the recording medium as being stiffer than normal, the refeeding speed control module 421 selects the slower refeeding speed V3, thereby increasing the torque output from the motor (not shown) in the refeeding roller driver 128.

As in the fourth embodiment, the interval during which the refeeding speed is controlled by the refeeding speed control module 421 begins when the leading edge of the recording medium passes the last refeeding roller pair 118, or at a predetermined time thereafter, and lasts until the leading edge of the recording medium arrives at the timing adjustment unit 104. While traveling from the first refeeding roller pair 116 to the last refeeding roller pair 118, the recording medium is preferably transported at the faster refeeding speed V2.

Figure 15:
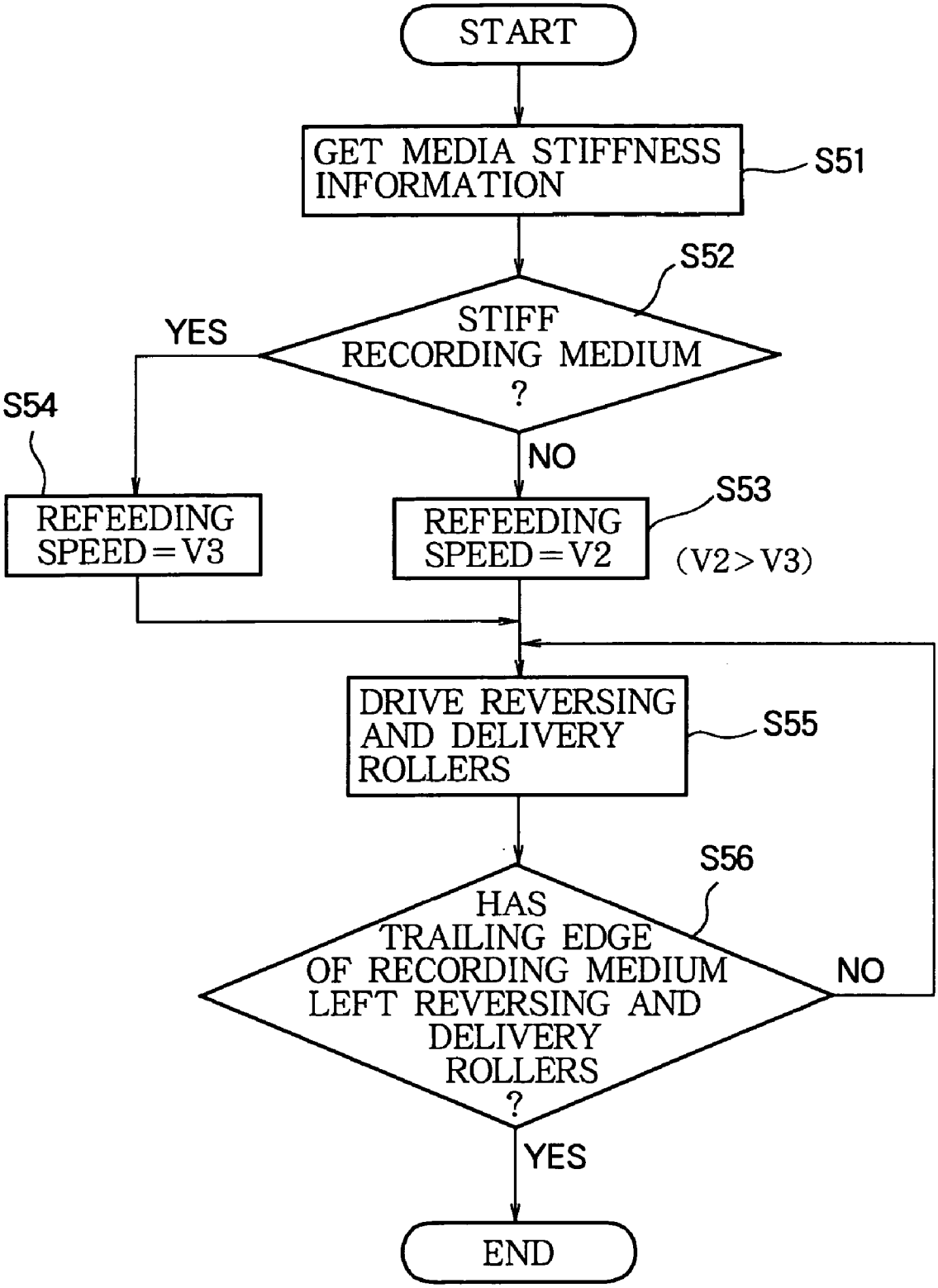
FIG. 15 is a flowchart illustrating the media refeeding operation in the fifth embodiment.

Next, the refeeding control operation in the fifth embodiment will be described with reference to the flowchart in FIG. 15. In double-sided printing, information on the stiffness of the recording medium is obtained (step S51), and whether the recording medium has normal stiffness or is stiffer than normal is determined (step S52). If the recording medium has normal stiffness, the refeeding speed is set to speed V2 (step S53); if the recording medium is stiffer than normal, the refeeding speed is set to speed V3 (step S54). The rotational speed of the refeeding rollers 116, 117, 118 is then controlled so as to transport the recording medium at the set speed (step S55) until the leading edge of the recording medium is determined to have arrived at the timing adjustment unit 104 (step S56).

The fifth embodiment has generally the same effects as the fourth embodiment, but by measuring the bending stiffness of the recording medium, which is a direct factor in the magnitude of the media transport load, the fifth embodiment can prevent transport failures more effectively.

The fifth embodiment may be combined with the second embodiment to control the media transport speed on both the reversing and refeeding parts of the return path.

Sixth Embodiment

Figure 16:
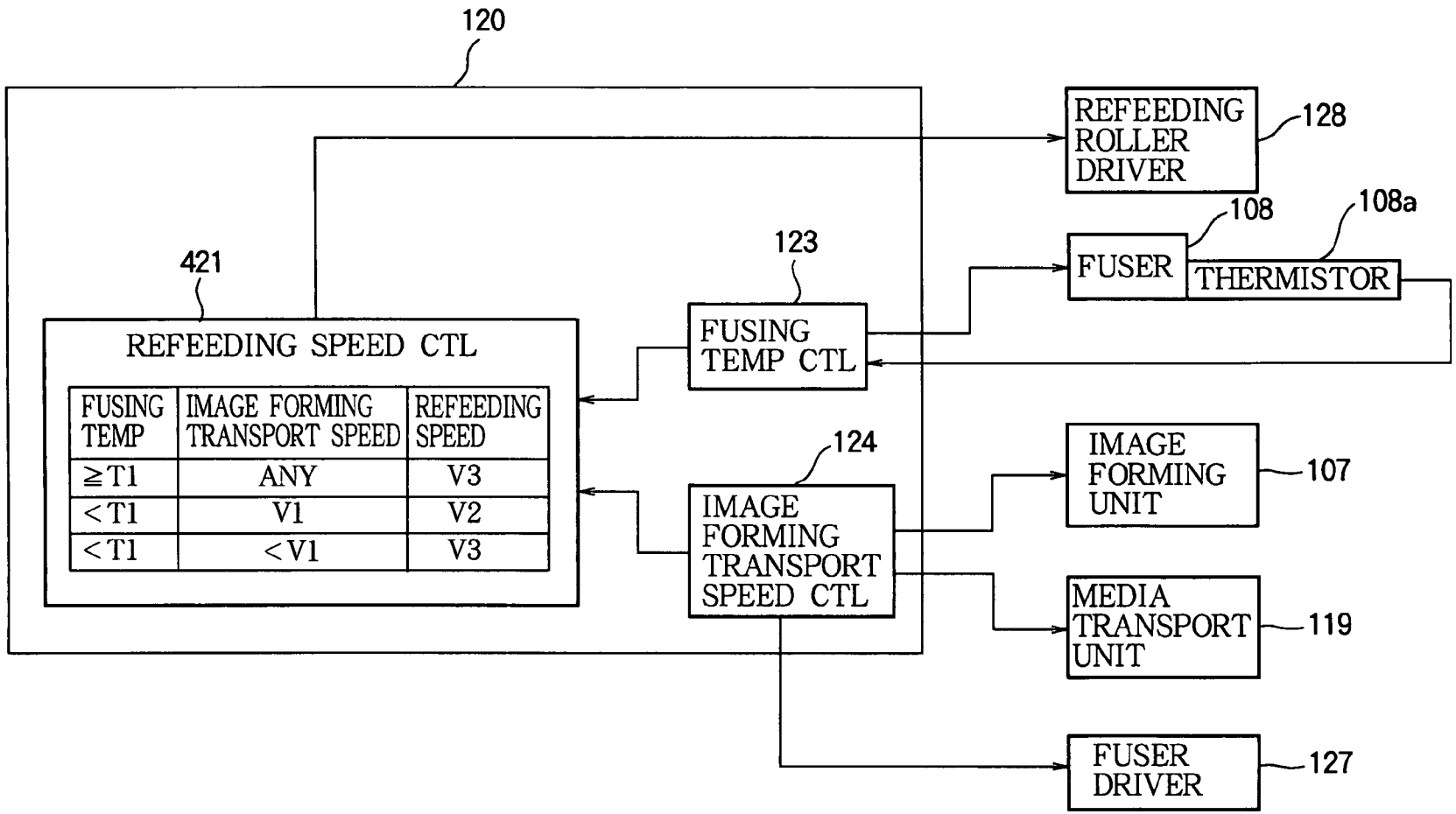
FIG. 16 is a block diagram showing the structure of the control system of an image forming apparatus according to a sixth embodiment of the invention.
Figure 17:
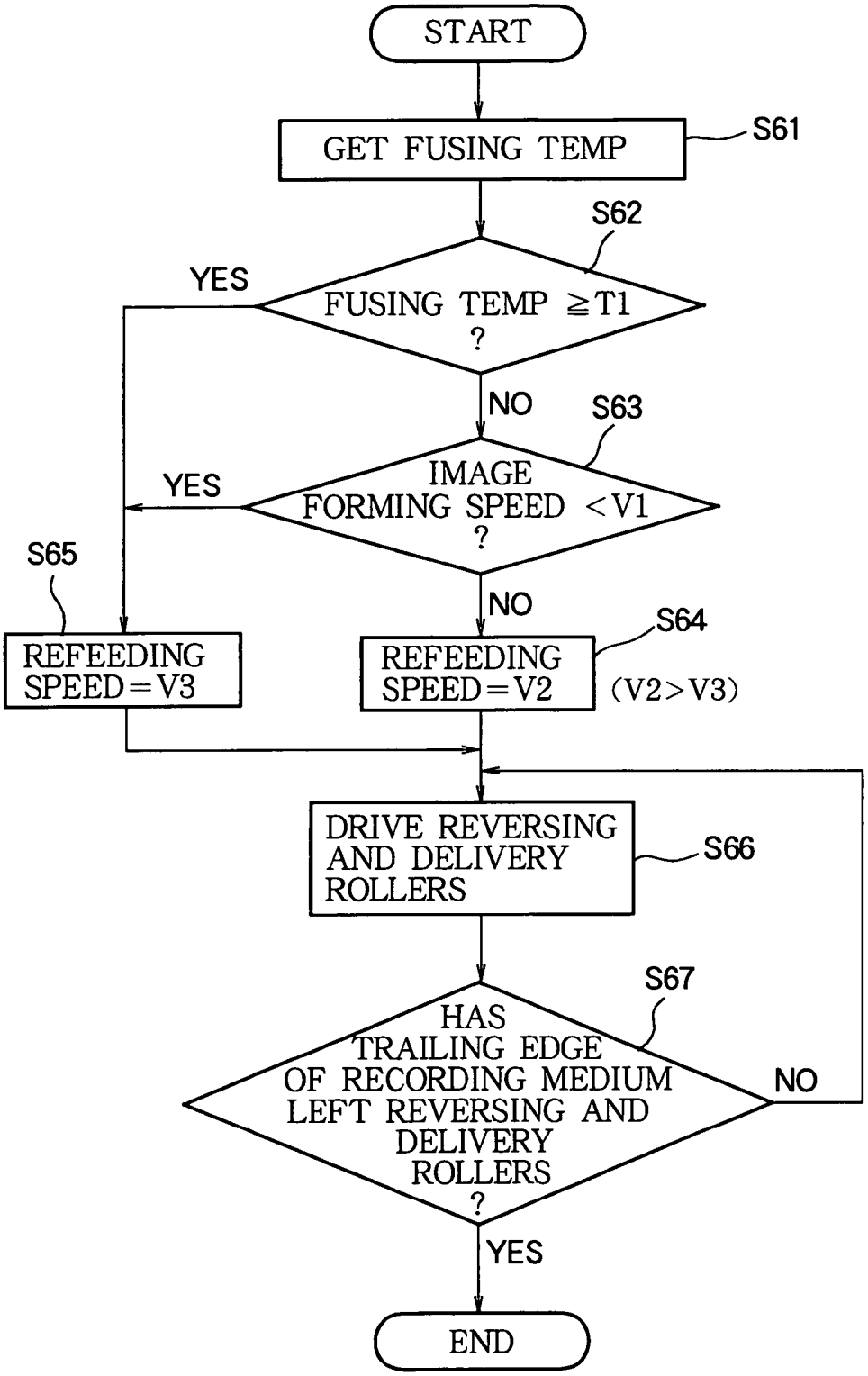
FIG. 17 is a flowchart illustrating the media refeeding operation in the sixth embodiment.
Figure 18:
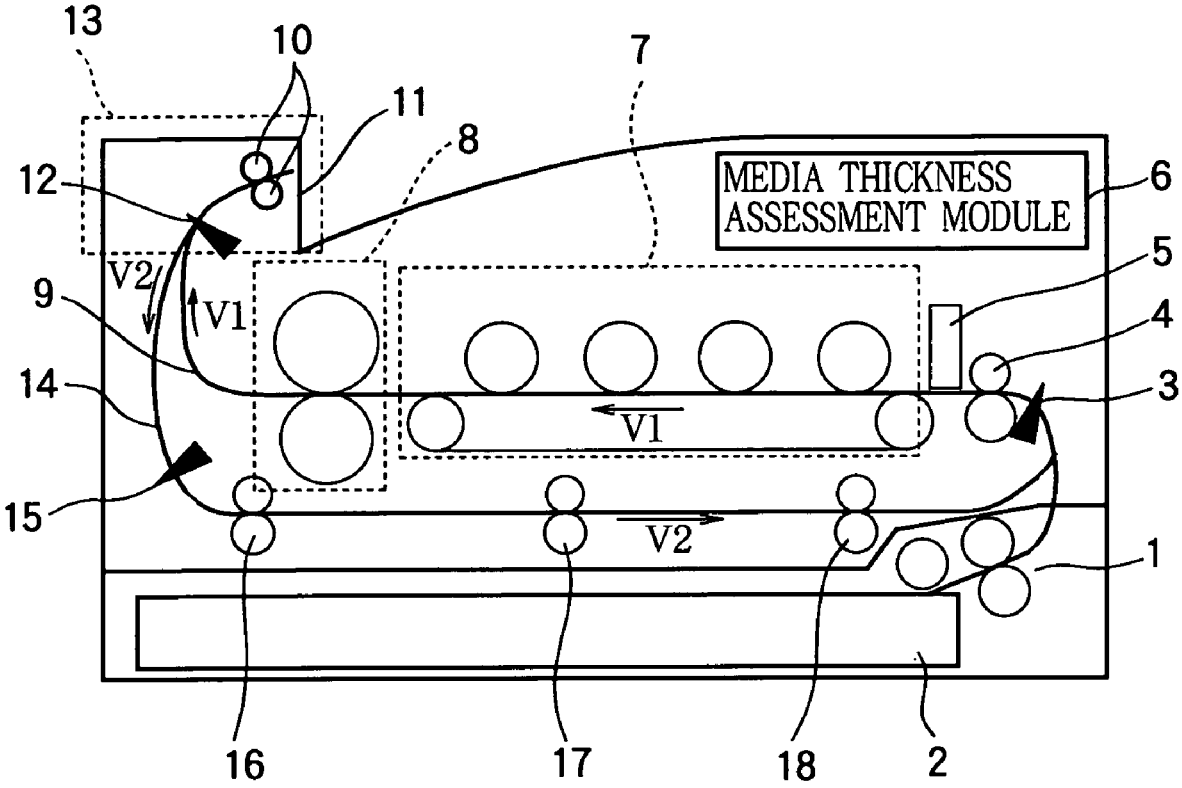
FIG.18 PRIOR ART
FIG. 18 illustrates the structure of the media transport path in a conventional image forming apparatus.

Referring to FIG. 16, the image forming apparatus in the sixth embodiment has the same control system as in the third embodiment, except that the reversing speed control module of the third embodiment is replaced by a refeeding speed control module 421 that controls a refeeding roller driver 128, as in the fourth and fifth embodiments. The refeeding speed control module 421 thus controls the rotational speed of the refeeding rollers 116, 117, 118, according to information received from the fusing temperature control module 123 and the image forming transport speed control module 124. If the fusing temperature is equal to or less than a threshold value T1 and the transport speed in the image forming unit is the normal speed V1, the refeeding transport speed is set to the comparatively high speed V2. If the fusing temperature is greater than or equal to the threshold temperature T1, or the transport speed in the image forming unit is less than the normal speed V1, the refeeding transport speed is set to the comparatively slow speed V3. Thick or stiff recording media can accordingly be transported without failure around the curves in the final part of the return path even when information directly relating to the thickness or stiffness of the recording media is unavailable.

Next, the refeeding operation in the sixth embodiment will be described with reference to the flowchart in FIG. 16. In double-sided printing, the fusing temperature setting is read (step S61) and compared with the threshold temperature T1 (step S62). If the fusing temperature is lower than T1, the image forming transport speed is compared with the normal image forming transport speed V1 (step S63). If the image forming transport speed is equal to (or greater than) the normal speed V1, the refeeding transport speed is set to the comparatively high speed V2 (step S64); if the transport speed transport speed is lower than V1, or the fusing temperature is greater than or equal to the threshold temperature T1, the refeeding transport speed is set to the comparatively slow speed V3 (step S65). The refeeding rollers 116, 117, 118 are then driven so as to transport the recording medium at the set speed (step S66) until the arrival of the leading edge of the recording medium at the timing adjustment unit 104 is recognized (step S67).

The sixth embodiment provides effects similar to those of the fourth and fifth embodiments even when information relating to the thickness or stiffness of the recording medium is unavailable. For example, the sixth embodiment is applicable to an image forming apparatus that does not have a media thickness or stiffness sensor but receives a fusing temperature setting from a host device. Like the third embodiment, the sixth embodiment has the advantage of not being vulnerable to sensor failures.

The sixth embodiment may be combined with the third embodiment to control the media transport speed on both the reversing and refeeding parts of the return path.

The present invention is not limited to image forming apparatus of the color electrophotographic type illustrated in the preceding embodiments. The invention can be applied to any apparatus that forms images on both sides of a recording medium by feeding the medium through an image forming unit twice. For example, the image may be formed by a monochrome electrophotographic process or an inkjet process.

Those skilled in the art will recognize that further modifications of the preceding embodiments are possible within the scope of the invention, which is defined by the appended claims.

What is claimed is:

1. An image forming apparatus comprising:

an image forming unit for forming an image on one side of a recording medium;

a transport unit for transporting the recording medium through the image forming unit at an image forming transport speed;

a sensor for sensing the type of recording medium transported by the transport unit;

a return unit for receiving the recording medium from the image forming unit, transporting the recording medium on a return path that reverses the orientation of the recording medium, and feeding the recording medium into the image forming unit again, so that the image forming unit can form an image on another side of the recording medium; and a control unit for setting different transport speeds for different types of recording media on at least part of the return path, according to the type of recording medium sensed by the sensor while the recording medium is being transported by the transport unit, and controlling the return unit so that the different types of recording media are transported at the different speeds, wherein the control unit keeps the image forming transport speed constant, and controls the return unit so that the recording medium is transported on at least part of the return path at a speed differing from the image forming transport speed; and a media thickness sensor for sensing thickness of the recording medium, wherein the control unit sets the transport speed on said at least part of the return path according to the sensed thickness of the recording medium.

2. The image forming apparatus of claim 1, wherein the control unit reduces the transport speed on said at least part of the return path for recording media of greater than a predetermined thickness.

3. The image forming apparatus of claim 1, further comprising a media stiffness sensor for sensing stiffness of the recording medium, wherein the control unit sets the transport speed on said at least part of the return path according to the sensed stiffness of the recording medium.

4. The image forming apparatus of claim 3, wherein the control unit reduces the transport speed on said at least part of the return path for recording media of greater than a predetermined stiffness.

5. The image forming apparatus of claim 1, further comprising a fuser for fusing the images formed by the image forming unit onto the recording medium and a fusing temperature control module for controlling a fusing temperature of the fuser, wherein the control unit sets the transport speed on said at least part of the return path according to the fusing temperature.

6. The image forming apparatus of claim 5, wherein the control unit reduces the transport speed on said at least part of the return path if the fusing temperature is higher than a predetermined temperature.

7. The image forming apparatus of claim 1, wherein the control unit sets the transport speed on said at least part of the return path according to a speed at which the transport unit transports the recording medium through the image forming unit.

8. The image forming apparatus of claim 1, wherein the control unit reduces the transport speed on said at least part of the return path if the speed at which the transport unit transports the recording medium through the image forming unit is slower than a predetermined speed.

9. The image forming apparatus of claim 1, further comprising a control panel, wherein the control unit sets the transport speed on said at least part of the return path according to information entered from the control panel.

10. The image forming apparatus of claim 1, wherein the image forming apparatus receives control information from a host device, and the control unit sets the transport speed on said at least part of the return path according to the control information received from the host device.

11. The image forming apparatus of claim 1, wherein the return path comprises a first part for reversing a transport direction of the recording medium and a second part for feeding the recording medium into the image forming unit.

12. The image forming apparatus of claim 11, wherein the part of the return path on which the control unit sets different transport speeds for different types of recording media includes said first part.

13. The image forming apparatus of claim 11, wherein the part of the return path on which the control unit sets different transport speeds for different types of recording media includes said second part.

14. The image forming apparatus of claim 11, wherein the return path includes a third part disposed between the first part and the second part, and the control unit sets a single transport speed for all types of recording media in the third part of the return path.

15. The image forming apparatus of claim 1, wherein the transport unit transports the recording medium through the image forming unit at a first speed and said different transport speeds include a second speed faster than the first speed and a third speed slower than the second speed.

16. The image forming apparatus of claim 15, wherein the third speed is equal to or greater than the first speed.

17. An image forming apparatus comprising:

an image forming unit for forming an image on one side of a recording medium;

a transport unit for transporting the recording medium through the image forming unit;

a return unit for receiving the recording medium from the image forming unit, transporting the recording medium on a return path that reverses the orientation of the recording medium, and feeding the recording medium into the image forming unit again, so that the image forming unit can form an image on another side of the recording medium;

a control unit for setting different transport speeds for different types of recording media on at least part of the return path, and controlling the return unit so that the different types of recording media are transported at the different speeds; and a fuser for fusing the images formed by the image forming unit onto the recording medium and a fusing temperature controller for controlling a fusing temperature of the fuser, wherein; the transport unit transports the different types of recording media through the image forming unit at different image forming transport speeds; and the control unit compares the image forming transport speed of the recording medium with a first speed, compares the fusing temperature with a predetermined temperature, selects a second speed faster than the first speed if the image forming transport speed is equal to or greater than the first speed and the fusing temperature is less than the predetermined temperature, selects a third speed slower than the second speed if the image forming transport speed is less than the first speed or the fusing temperature is equal to or greater than the predetermined temperature, and sets the selected second or third speed for said at least part of the return path.

* * * * *